US009114859B2

(12) United States Patent
Biaggi

(10) Patent No.: US 9,114,859 B2
(45) Date of Patent: Aug. 25, 2015

(54) DEVICE FOR TRANSFERRING A FLUID TO A SHIP

(75) Inventor: Jean Pascal Biaggi, Le Celle Saint Cloud (FR)

(73) Assignee: TECHNIP FRANCE (FR)

( * ) Notice: Subject to any disclaimer, the term of this patent is extended or adjusted under 35 U.S.C. 154(b) by 1437 days.

(21) Appl. No.: 12/305,482

(22) PCT Filed: Jun. 18, 2007

(86) PCT No.: PCT/FR2007/001006

§ 371 (c)(1),
(2), (4) Date: Dec. 18, 2008

(87) PCT Pub. No.: WO2007/147963

PCT Pub. Date: Dec. 27, 2007

(65) Prior Publication Data

US 2009/0272459 A1 Nov. 5, 2009

(30) Foreign Application Priority Data

Jun. 19, 2006 (FR) ..... 06 05434

(51) Int. Cl.

| | |
|---|---|
| ***B65B 1/04*** | (2006.01) |
| ***B66B 3/00*** | (2006.01) |
| ***B67C 3/00*** | (2006.01) |
| ***B63B 27/25*** | (2006.01) |
| ***B63B 27/24*** | (2006.01) |
| ***B63B 27/34*** | (2006.01) |
| ***B67D 9/00*** | (2010.01) |

(52) U.S. Cl.

CPC ..... *B63B 27/25* (2013.01); *B63B 27/24* (2013.01); *B63B 27/34* (2013.01); *B67D 9/00* (2013.01)

(58) Field of Classification Search

CPC ..... B63B 27/24; B63B 27/34; B63B 27/25; B67D 9/00

USPC ..... 141/382, 1, 386, 387; 248/74.5, 65, 72, 248/73; 114/230.1, 230.25, 230.26

See application file for complete search history.

(56) References Cited

U.S. PATENT DOCUMENTS

| | | | | |
|---|---|---|---|---|
| 3,236,267 | A * | 2/1966 | Bily | 141/1 |
| 3,921,684 | A | 11/1975 | Allen | |
| 4,261,398 | A * | 4/1981 | Haley | 141/387 |

(Continued)

FOREIGN PATENT DOCUMENTS

| | | | |
|---|---|---|---|
| FR | 2 425 373 | A1 | 12/1979 |
| WO | WO 02/28765 | A1 | 4/2002 |
| WO | WO 03/004925 | A1 | 1/2003 |

OTHER PUBLICATIONS

International Search Report dated Dec. 3, 2007, issued in corresponding international application No. PCT/FR2007/001006.

*Primary Examiner* — Jason Boeckmann
*Assistant Examiner* — Steven M Cernoch
(74) *Attorney, Agent, or Firm* — Ostrolenk Faber LLP

(57) ABSTRACT

A filling platform connected to a ship, and at least one manifold which opens onto the platform. A detachable tubular connector connects the manifold to a fluid delivery hose carried by a delivery installation. At least one carriage conveys the connector over the platform. The carriage is moveable across the platform to convey the tubular connector over the platform between a storage position and an active position, in which latter position, the connector is fixed to the manifold. The system is applicable to the transfer of liquefied natural gas from offshore storage installations to tanker ships.

16 Claims, 6 Drawing Sheets

(56) References Cited

U.S. PATENT DOCUMENTS 4,867,211 A * 9/1989 Dodge et al. ..... 141/279
6,623,043 B1 * 9/2003 Pollack ..... 285/121.2
6,637,479 B1 * 10/2003 Eide et al. ..... 141/387
7,147,021 B2 * 12/2006 Dupont et al. ..... 141/382
2003/0172991 A1 * 9/2003 de Baan ..... 141/382
2004/0154697 A1 * 8/2004 Dupont et al. ..... 141/382

* cited by examiner

DEVICE FOR TRANSFERRING A FLUID TO A SHIP

CROSS REFERENCE TO RELATED APPLICATION

The present application is a 35 U.S.C. §§371 national phase conversion of PCT/FR2007/001006, filed 18 Jun. 2007, which claims priority of French Application No. 06 05434, filed 19 Jun. 2006. The PCT International Application was published in the French language.

BACKGROUND OF THE INVENTION

The present invention relates to a device for transferring a liquid to a ship, of the type comprising:

- a loading platform intended to be integral with the ship;
- at least one manifold which opens out onto the platform;
- at least one displaceable tubular connection intended to connect the manifold to a flexible hose for distributing liquid, the flexible hose being supported by a liquid distribution installation.

A device of this type is particularly suitable for transferring liquefied natural gas (LNG) between a transport ship and an offshore installation for storing the product and/or an installation for unloading this product, known as a terminal.

It is known to load or unload tankers at sea by mooring said tanker to an offshore loading or unloading terminal to transport liquefied natural gas between offshore production regions and storage areas in the vicinity of the coast.

These terminals preferably comprise a flexible cryogenic hose which is suspended from a gantry crane provided on the terminal.

In order to allow the ship to be loaded or unloaded with LNG, the flexible cryogenic hose should be connected to a loading pipe system, referred to as the "manifold" of a tanker.

Since there is a large number of tankers on the seas, it is necessary to provide a displaceable rigid connection which can adapt to the flexible hose on the one hand and to the manifold of a particular ship on the other.

For this purpose, EP-A1 324 994 discloses a transfer device of the aforementioned type in which the tubular connection is stored on the offshore LNG loading/unloading installation when at rest, and is subsequently connected to the ship manifold by a crane after the ship has moored to the installation.

A device of this type is not entirely satisfactory, since when seas are rough the relative movement of the ship in relation to the installation makes fixing a rigid tubular connection to the manifold considerably more difficult. These manoeuvring difficulties make transferring liquid time-consuming and not very reliable.

BRIEF DESCRIPTION OF THE INVENTION

The invention relates to providing a device for transferring a liquid between an installation for loading or unloading this liquid and a ship, which enables the installation and the ship to be connected in a rapid and reliable manner, even in rough seas.

For this purpose, the invention relates to a device of the aforementioned type, characterised in that the device comprises at least one carriage for transporting the tubular connection over the platform, the carriage being displaceable over the platform to transport the tubular connection between a storage position and an active position in which it is fixed to the manifold.

The device according to the invention may comprise one or more of the following features, either alone or in any technically feasible combination:

- the device comprises means for locking the carriage in position relative to the platform in the active fixed position, the locking means being able to be activated in the absence of the tubular connection on the carriage;
- the device comprises means for entraining the carriage relative to the platform, said means being supported by the ship;
- the device comprises a track for guiding the carriage which is integral with the platform, the displacement of the carriage over the platform between the storage position and the active fixed position being controlled along the guide track;
- the carriage comprises wheels which roll over the platform;
- in the vicinity of the active fixed position, the carriage can be displaced relative to the platform in a first direction and, when the connection is mounted on the carriage, the connection is fixed relative to the carriage in a first direction and can be displaced relative to the carriage towards the manifold in a second direction which differs from the first direction;
- the carriage comprises a cradle, which rotatably receives a connection, and adjustable means for blocking the rotation of the connection relative to the cradle;
- the adjustable blocking means comprise at least one blocking rib which is integral with either the tubular connection or the cradle and, for the or each rib, a groove provided in the other of the tubular connector or the cradle, the groove receiving the blocking rib;
- the tubular connection can be displaced relative to the carriage between a storage configuration in a storage region in the ship, in which configuration the carriage can be displaced independently of the connection, and a transport configuration in which the tubular connection and the carriage can be displaced together;
- in the active fixed position of the carriage, the tubular connection projects beyond the platform, the manifold being located in a set-back position on the platform;
- the device comprises a plurality of connections which are capable of being mounted on the same carriage; and
- the carriage comprises means for adjusting the height of the connection relative to the height of the manifold.

The invention also relates to a ship, characterised in that it comprises a transfer device as described above and a tank of liquid connected to the manifold, the platform being integral with the ship.

The invention further relates to an assembly for transferring a liquid, characterised in that it comprises:

- an installation for transferring liquid, the installation being in contact with a body of water and comprising a flexible hose for distributing liquid;
- a ship as described above which floats on the body of water, the flexible hose being connected to the tubular connection.

The invention also relates to a method for transferring a liquid to a ship in an assembly as defined above, characterised in that it comprises the following steps:

- providing a carriage positioned on a platform which is integral with the ship, the carriage supporting a tubular connection which is stored on the ship when at rest;
- displacing the carriage over the platform between its storage position and its active fixed position in order to transport the tubular connection over the platform, while keeping the carriage in contact with the platform between said positions;

fixing the tubular connection to the manifold; and connecting the flexible hose to the tubular connection.

The method according to the invention may include the following feature:

the tubular connection can be displaced relative to the carriage between a storage configuration in which it is located in a storage region of the ship away from the carriage and a transport configuration in which it is mounted on the carriage, the step of providing a carriage comprising the displacement of a connection from the storage configuration to the transport configuration thereof.

BRIEF DESCRIPTION OF THE DRAWINGS

A clearer understanding of the invention will be facilitated by the following description, given purely by way of example and provided in reference to the appended drawings, in which.

DESCRIPTION OF A PREFERRED EMBODIMENT

Figure 1:
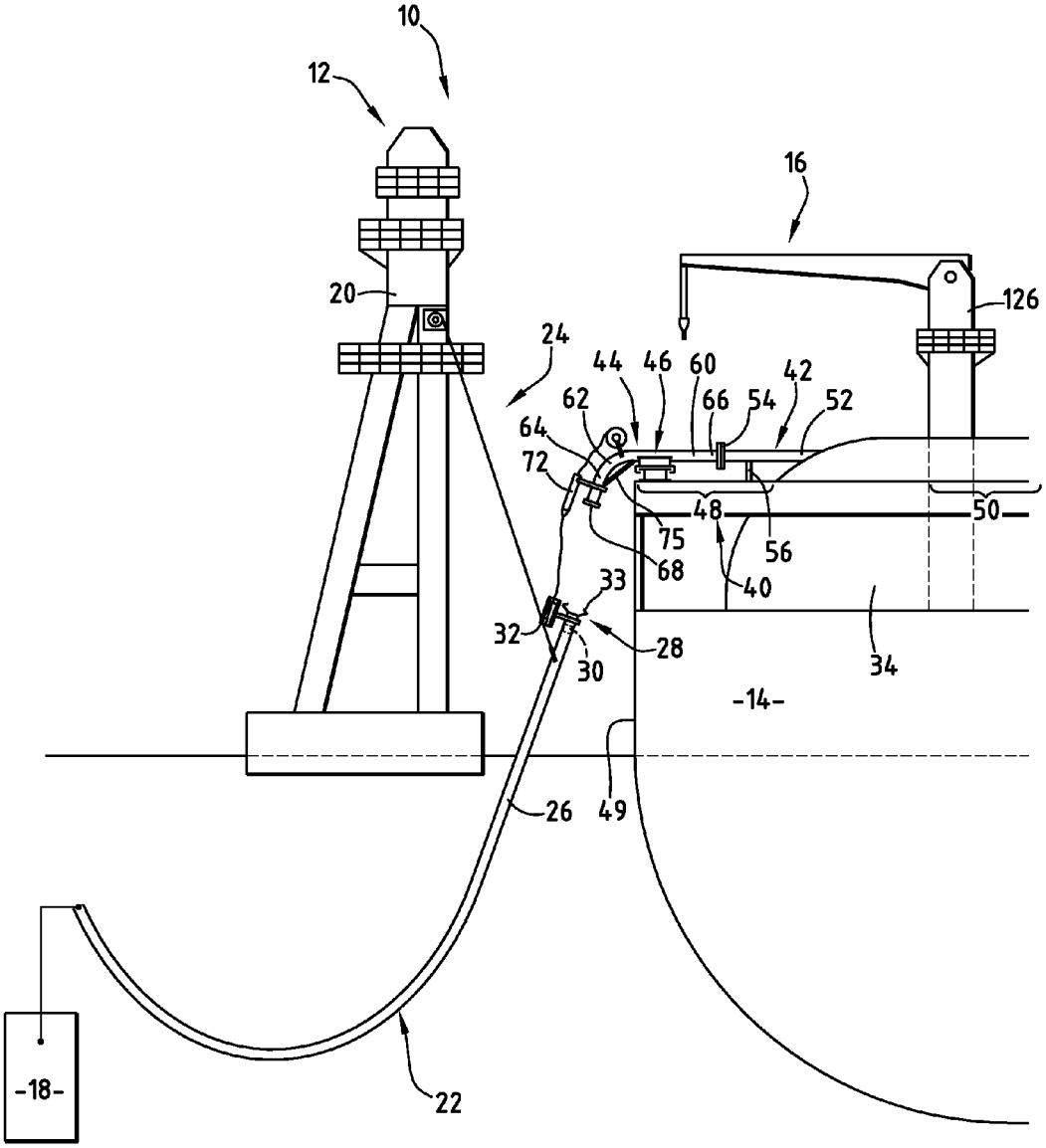
FIG. 1 is a schematic elevation of an LNG transfer assembly comprising a transfer device according to the invention during the connection thereof to a distribution installation.

An assembly 10 for transferring a liquid, in particular a hydrocarbon composed of liquefied natural gas (LNG) for example, is shown in FIGS. 1 to 6.

The transfer assembly 10 comprises an offshore installation 12 for loading or/and unloading LNG, a ship 14 for storing and regasifying LNG, and a device 16, carried by the ship 14, for transferring LNG between the installation 12 and the ship 14.

The loading installation 12 comprises an LNG reservoir 18, a floating gantry crane 20 for unloading LNG, a flexible cryogenic hose 22 which connects the reservoir 18 to the gantry crane 20, and handling means 24 for manoeuvring the flexible hose 22.

The reservoir 18 is capable of collecting and storing LNG produced by LNG production installations. It is preferably located under the sea.

The floating gantry crane 20 carries the flexible hose 22 via the handling means 24.

The flexible hose 22 comprises a cryogenic hose 26 which is provided with a free end 28 to be connected to the transfer device 16. The hose is, for example, of the type developed and sold by FLEXI FRANCE.

The free end 28 comprises, in a known manner, a butterfly safety valve 30 of the type disclosed in application WO 03/004925, and a guide sleeve 32 which is connected to the cryogenic hose 26 and extends parallel to said hose 26 towards the ship 14 in the region of the free end 28. The free end 28 further comprises a clamp connector 33, shown for example in EP-A 1 324 944.

The ship 14 comprises at least one LNG tank 34 which is located in the central portion of said ship. In the following, the terms "interior", "exterior", "longitudinal", "transverse", "front" and "rear" are used in reference to the ship 14.

Figure 2:
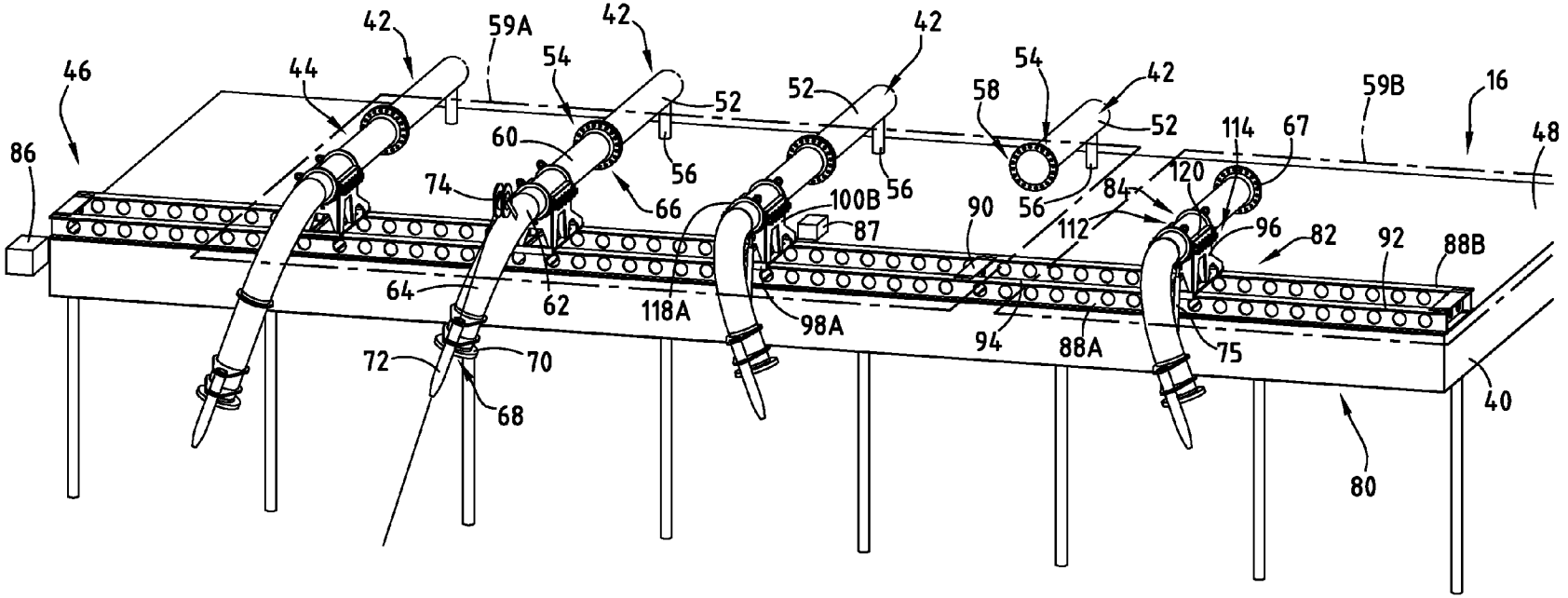
FIG. 2 is a three-quarter schematic perspective view of the transfer device from FIG. 1.

As shown in FIG. 2, the transfer device 16 comprises a loading platform 40, a plurality of manifolds 42 which open out onto the platform 40, a plurality of displaceable tubular connections 44 which are intended to connect a manifold 42 to the flexible hose 22, and means 46 for transporting each connector 44 over the platform 40.

As shown in FIG. 1, the platform 40 is integral with the deck of the ship 14. It comprises a region 48 for transferring LNG and a region 50 for storing the tubular connections 44.

The transfer region 48 extends along a lateral side 49 of the ship 14 without projecting beyond the lateral side 49 of the ship 14.

The storage region 50 is located for example in the central portion of the ship, at a distance from the sides 49.

In the example shown in FIG. 2, the transfer device 16 comprises four manifolds 42 which are spaced longitudinally in the transfer region 48.

Each manifold 42 comprises an LNG transfer pipe 52 which extends substantially transversely between a tank 34 and a connection end 54.

In the vicinity of its connection end 54, the pipe 52 is provided with a leg 56 which is positioned on the transfer region 48 of the platform 40.

The connection end 54 opens out transversely above the transfer region 48 in a set-back position relative to the lateral side 49 of the ship. This end 54 therefore does not impede the manoeuvres made by the ship 14 during navigation when the tubular connection 44 is not connected to the manifold 42.

The connection end 54 has a peripheral flange 58 in which a plurality of holes for fixing a tubular connection 44 are formed.

The manifolds 42 delimit, in the transfer region 48, a connection zone 59A, on the left in FIG. 2, which is located transversely opposite each manifold 42 and between each pair of adjacent manifolds 42, and a zone 59B, shown on the right in FIG. 2, for storing the transport means 46, said zone being located at a distance from the manifolds 42.

The connection zone 59A extends along an axis which is substantially perpendicular to the axis of the manifold 42 between the end manifold 42 which is the furthest forward and the end manifold 42 located the furthest towards the rear.

In this example, the storage zone 59B extends towards the rear from the manifold 42 located the furthest towards the rear, in the direction away from the manifold 42 furthest towards the front.

Figure 3:
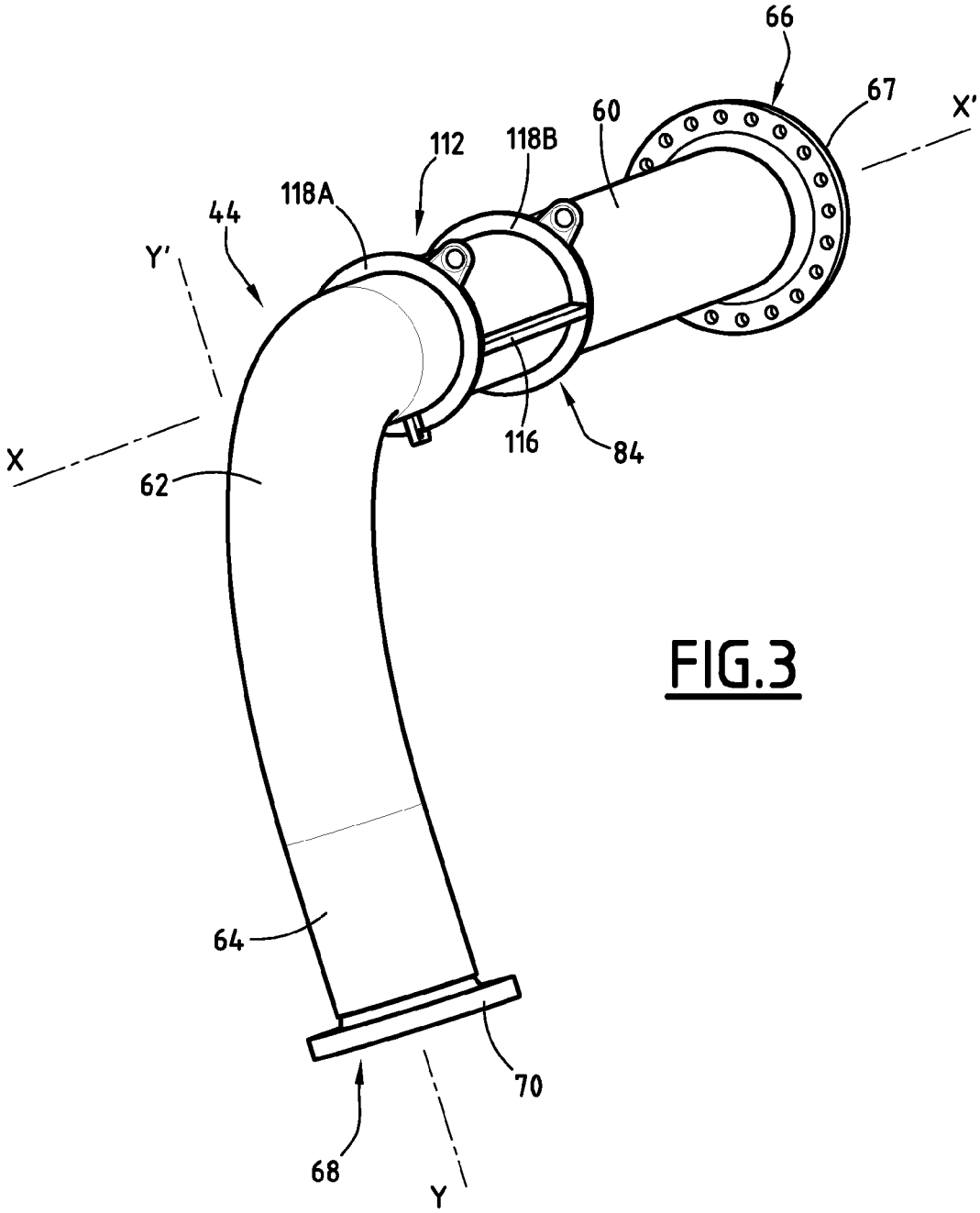
FIG. 3 is a perspective side view of a tubular connection of the device from FIG. 2.

As shown in FIGS. 2 and 3, each connection 44 is formed by a rigid hollow metal pipe, the interior of which delimits a liquid circulation channel.

Each connection 44 thus comprises an inner portion 60 which is supported by the transport means 46, an elbow 62 and an outer portion 64 intended to be connected to the flexible hose 22. In this example, the portions 60, 64 and the elbow 62 are formed in one piece.

When the connection 44 is connected to a manifold 42, the inner portion 60 extends substantially along a transverse axis X-X' which extends from the pipe 52 facing the transfer region 48.

The connection 44 has an inner end 66 which is provided with a complementary flange 67 to be fixed to the flange 58 of the manifold 42. The flanges 58 and 67 are sized so as to correspond with one another. The complementary flange 67 is mounted so as to rotate about the axis X-X' relative to the inner portion 60. This facilitates the alignment and clamping of the complementary flange 67 relative to the flange 58 of the manifold in order to connect the two and to lock one to the other, irrespective of the angular position of the inner portion 60 and the outer portion 64 about the axis X-X'.

The liquid circulation channel opens out internally at the centre of the flange 67.

The elbow 62 straddles the lateral side 49 of the ship 14 and connects the inner portion 60 to the outer portion 64.

When the connection 44 is fixed to a manifold 42, the outer portion 64 projects transversely downwards out of the region 48, beyond the lateral side 49 of the ship 14. In the vicinity of its outer end 68, it extends along an axis Y-Y' which forms an angle of between 90° and 150° with the axis X-X' of the inner portion 60.

The outer end 68 of the outer portion 64 has a collar 70 to be connected to the free end 28 of the flexible hose 22. The portion 64 is further provided, in the vicinity of its outer end 68, with a guide rod 72 which is intended to be introduced into the guide sleeve 32, and with a winch 74 for pulling the free end 28. The rod 72 extends parallel to the portion 64.

The connection 44 is further provided with a reinforcing bar 75 which connects the outer end 68 of the outer portion 64 to the inner portion 60. The bar 75 extends below the elbow 62 to limit the extent to which the outer portion 64 bends in relation to the inner portion 60 when the flexible hose 22 is connected to the connection 44.

As will be shown below, each tubular connection 44 can be displaced relative to the transport means 46. Therefore, each connection 44 can be displaced between a storage configuration in which it is at rest in the storage region 50 and a transport configuration in which it is mounted on the transport means 46.

In order to be fitted to the different types of flexible hoses 22 on the different offshore loading installations 12, the ship 14 comprises a plurality of connections 44 which have connection collars 70 of different sizes. These different connections 44 are stored in the storage region 50 when at rest.

As shown in FIG. 2, the transport means 46 comprise a guide frame 80, which is fixed to the transfer region 48 of the platform 40, a plurality of carriages 82 for transporting the tubular connections 44, which carriages are mounted in a displaceable manner on the platform 48 by means of the frame 80, and means 84 for releasably fixing the connection 44 to the carriage 82 for each carriage 82.

The transport means 46 further comprise means 86 (shown in FIG. 2) for entraining the carriages 82, and means 87 for locking the carriages 82 in position.

The frame 80 is formed by metal profiled parts with an I-shaped vertical section. It comprises two longitudinal rails 88A, 88B which are fixed to the transfer region 46 of the platform 40 and are connected to one another by cross-members 90.

The rails 88A, 88B extend parallel to one another perpendicular to the manifolds 42 and face said manifolds. The outer rail 88A is fixed to the platform 48 along the outer edge of the platform 40, whereas the rail 88B is fixed towards the interior of the platform 40.

The rails 88A, 88B extend continuously along the connection zone 59A and the storage zone 59B.

Each rail 88A, 88B comprises an upper surface 92, along which the carriages 82 slide, and a horizontal rim 94 for guiding the carriages 82 which extends away from the rail.

The frame 80 thus forms means for displacing the carriage 82 over the platform 40.

Figure 4:
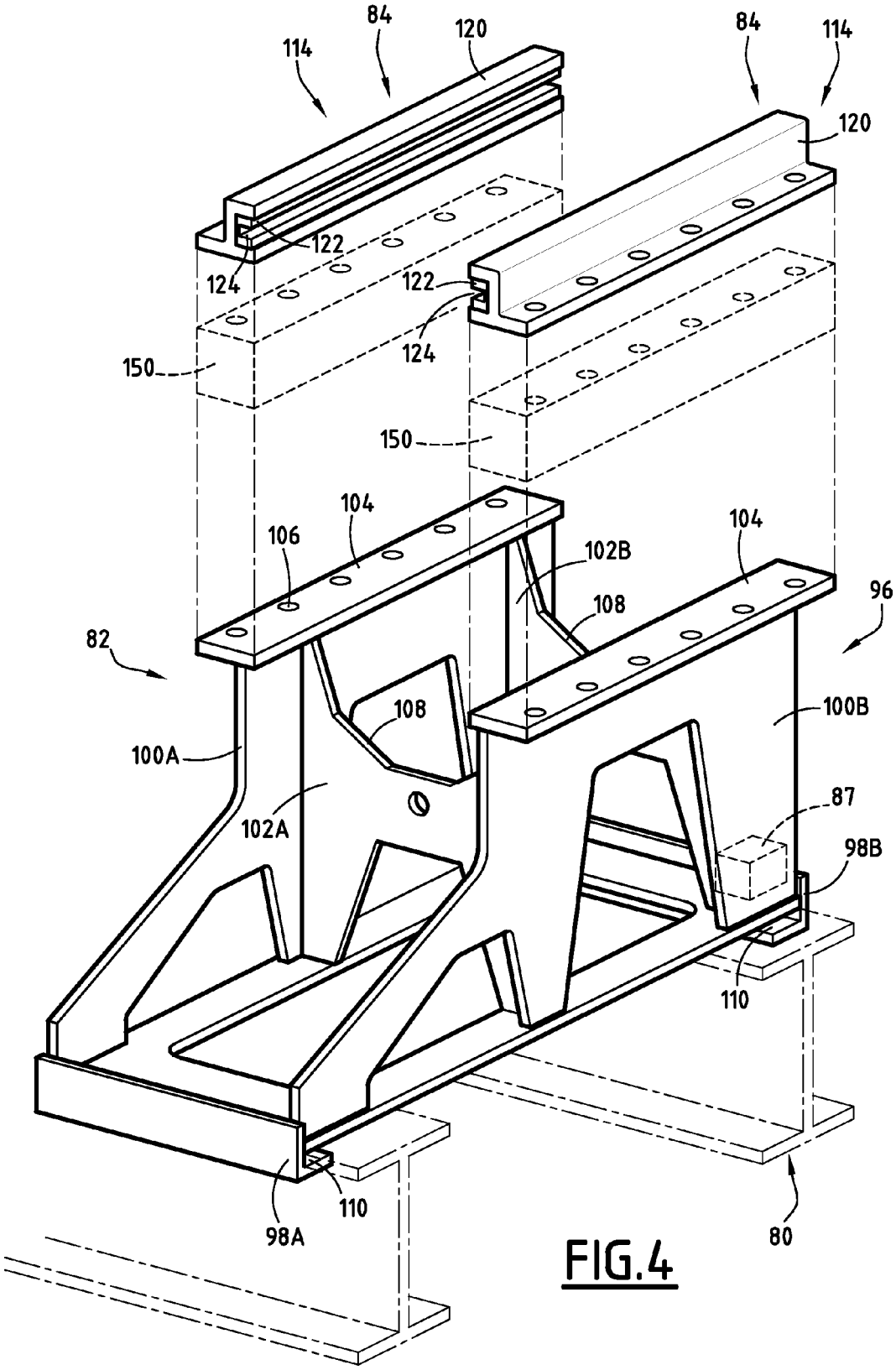
FIG. 4 is an exploded perspective view of a carriage for displacing the tubular connection from FIG. 3.
Figure 5:
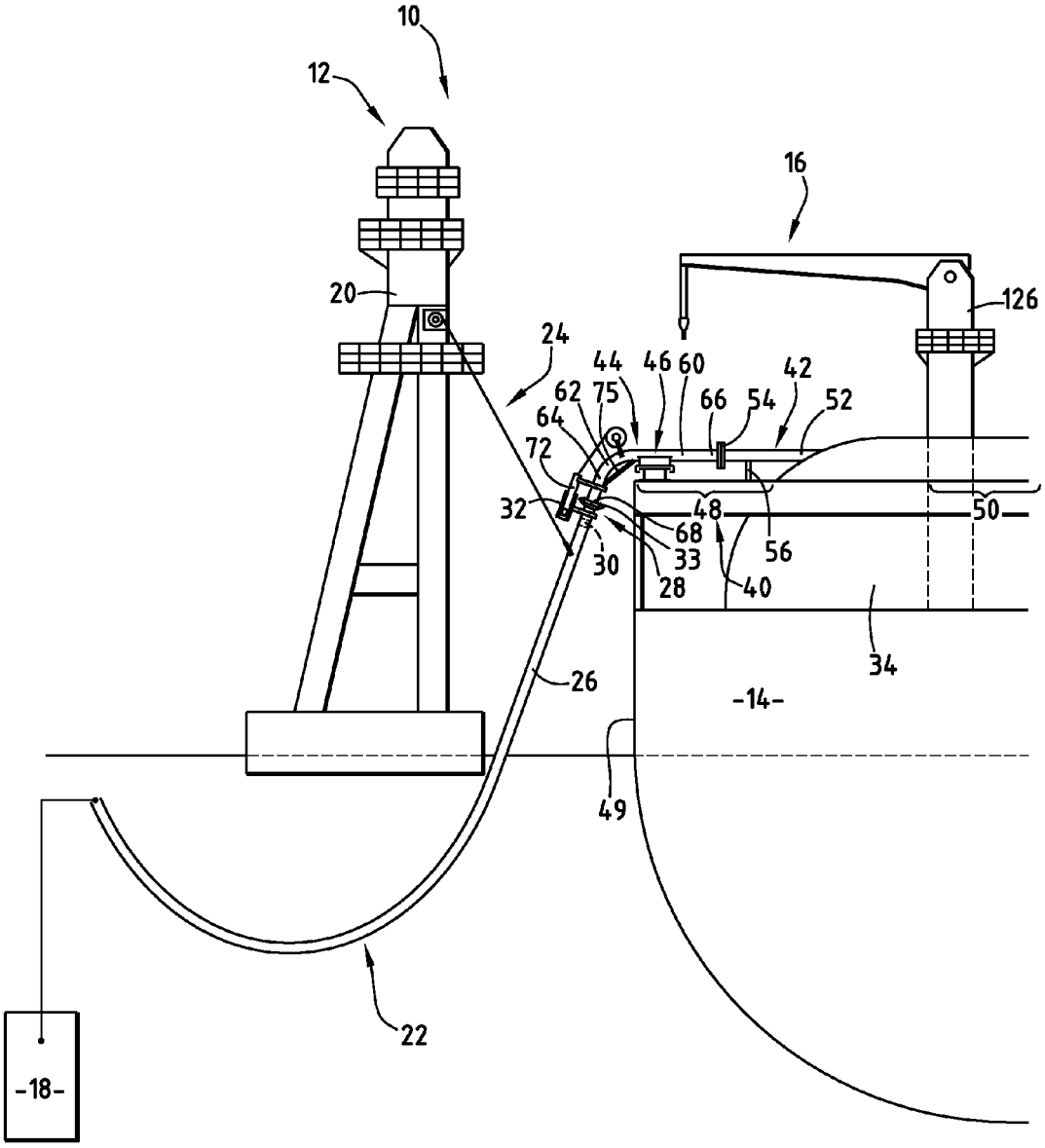
FIG. 5 is a view similar to that of FIG. 1 during transfer of LNG between a distribution installation and a ship.

As shown in FIG. 4, each carriage 82 comprises a cradle 96 for supporting a connection 44, and two sliding tracks 98A, 98B for guiding the carriage 82 over the rails 88A, 88B.

The cradle 96 comprises two lateral plates 100A, 100B and two cross members 102A, 102B which connect the plates 100A, 100B.

The plates 100A, 100B extend in substantially transverse vertical planes when the carriages 82 are located on the rails 88A, 88B facing the manifolds 42.

Each lateral plate 100A, 100B has a horizontal upper rim 104 for receiving fixing means 84, and which comprises a plurality of screw holes.

The cross members 102A, 102B extend in a longitudinal vertical plane when the carriage 82 is located on the rails 88A, 88B facing the manifolds 42.

Each cross member 102A, 102B delimits a U-shaped upper edge 108 which opens upward.

The inner sliding tracks 98A, 98B connect the outer ends and inner ends respectively of the plates 100A, 100B underneath said plates 100A, 100B.

Each sliding track 98A, 98B delimits a longitudinal slot 110, the shape of which complements that of the rim 94 of a rail 88A, 88B. The slots 10 open horizontally and face one another. They receive the respective rims 94 of the respective rails 88A, 88B.

The carriage 82 can be slidingly displaced along the rails 88A, 88B between a storage position, which is located at a longitudinal distance from the manifolds 42 in the storage zone 59B at one end of the rails 88A, 88B, and a plurality of active fixed positions, which are each located opposite a manifold 42 in the connection zone 59A. The zone 59B for storing the carriages 82 is located in the vicinity of the region 50 for storing the connections 44 in order to minimise the distance between the connections 44 in the storage region 50 and the carriages 82 in the storage position.

The frame 80 thus forms a track for guiding the carriage 82, which track controls the displacement of the carriage 82 in contact with the platform 40 by means of the rails 88A, 88B. The carriage 82 is thus permanently mounted to the platform 40.

As shown in FIGS. 3 and 4, the fixing means 84 comprise a blocking assembly 112 which is fixed to each connection 44 and a complementary blocking assembly 114 fixed to the carriage 82.

The blocking assembly 112 comprises two transverse rods 116 which are fixed axially along the inner portion 60 of the connection 44, and collars 118A, 118B to hold the rods 116 in position resting against the pipe 60.

The rods 116 extend horizontally on either side of the portion 60 between the outer collar 118A and the inner collar 118B. The ends of each rod 116 are integral with the outer collar 118A and inner collar 118B.

Each collar 118A, 118B releasably surrounds a circumferential portion of the inner portion 60. When the collars 118A, 118B are released, the connection 44 is free to rotate about the axis X-X' of the inner portion.

When the connection 44 is arranged on the carriage 82, the cross members 102A, 102B are positioned between the collars 118A, 118B.

The complementary blocking assembly 114 for each rod 116 comprises a blocking fitting 120 which is fixed by means of screws on one of the rims 104 respectively. Each fitting 120 opens horizontally towards the connection 44 and contains a plastics material lining 122 for clamping the rod 116.

The lining 122 defines a horizontal slot 124 which has a shape which is substantially complementary to that of the rod 116. The slot 124 opens towards the rod 116 and transversely opens out at its outer and inner edges. The slot 124 receives the rod 116 when the connection 44 is mounted on the carriage 82.

The cooperation between the rods 116 and the linings 122 prevent the connection 44 from rotating about the axis X-X' of the inner portion 60 when the collars 118A, 118B are clamped, but still allow the connection 44 to be displaced in translation along the axis X-X' between the collars 118A, 118B, relative to the carriage 82.

In a variant, the fittings 120 are carried at rest by the connections 44. They are engaged with the rods 116 before the fittings 120 are fixed to the rims 104.

The fixing means 86 allow any connection from the different connections 44 which are stored on the ship 14 to be mounted selectively on the same carriage 82.

The entrainment means 86 comprise for example a winch which is carried by the ship 14 and is located at one end of the frame. The winch is capable of using traction to displace the carriages 82 along the rails 88A, 88B between their storage position and the plurality of fixed positions.

The locking means 87 are formed for example by a brake which is mounted on the carriage 82 and is capable of immobilising the carriage 82 relative to the rails 88A, 88B.

The ship 14 further comprises a crane 126 which is capable of carrying each connection 44 from the storage region 50 towards the transfer region 48 in order to position said connection on a transport carriage 82.

The operation of the transfer assembly 10 according to the invention will be described below.

Figure 6:
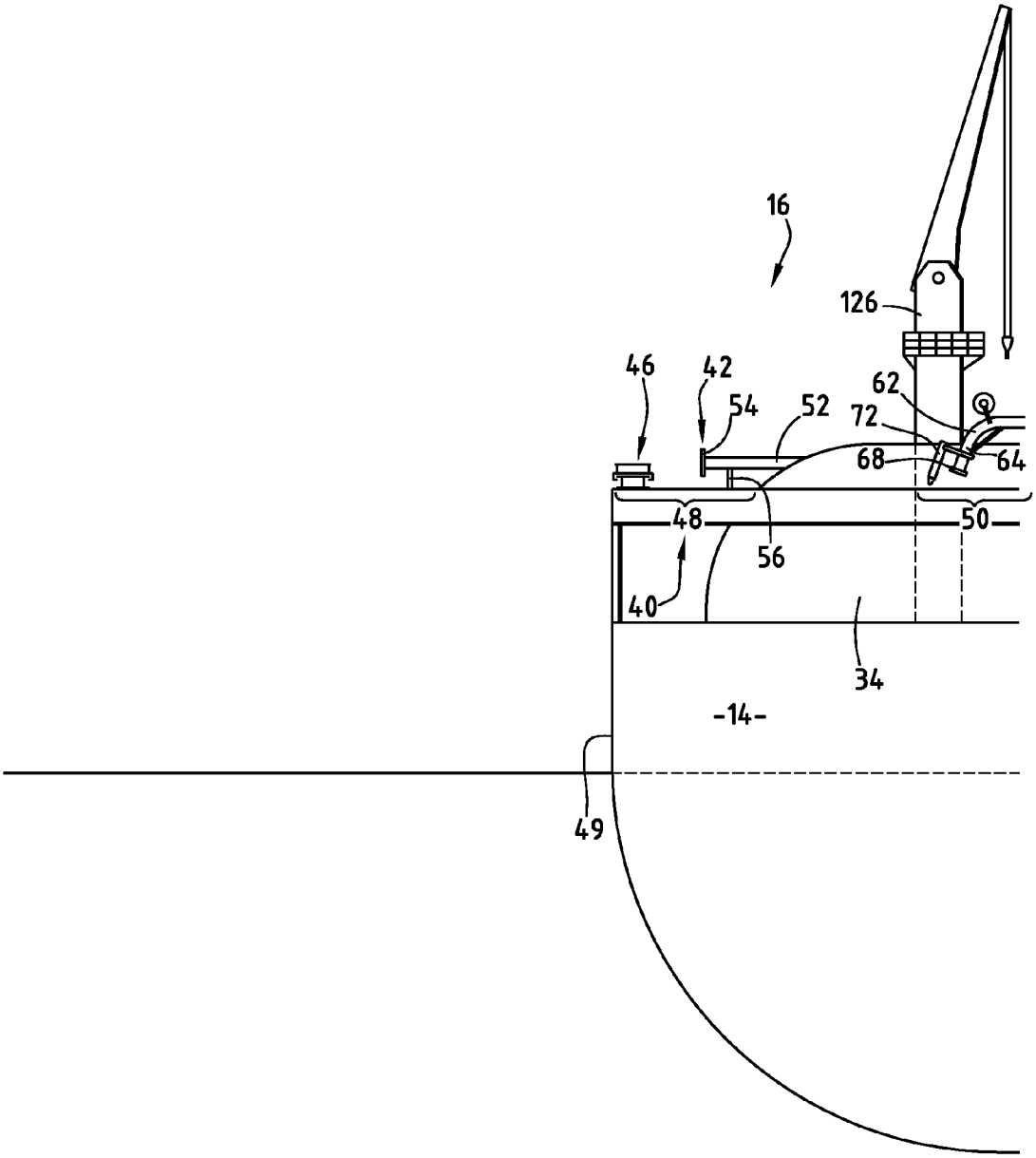
FIG. 6 is a view similar to that of FIG. 1, the ship having moved away from the installation after being loaded.

With reference to FIG. 6, when the ship 14 is sailing away from an installation 12, the connections 44 are located in the storage region 50 of the ship 14, away from the manifolds 42 and the carriages 82.

The carriages 82 are stored in the storage positions thereof, located at the ends of the rails 88A, 88B. They can be displaced over the platform 40 independently of the connections 44. The blocking fittings 120 are removed. In this way, the ship 14 does not have any pipes which are connected to the tank 34 and also project beyond the lateral side 49 of the ship. Furthermore, the space within the connection zone 59A on the platform 40 facing the manifolds 42 remains clear and accessible from outside.

When the ship 14 approaches an installation 12, a connection 44, which has an outer end 68 with dimensions matched to those of the flexible hose 22 of this installation 12, is transported by the crane 126 from the storage region 50 to the transfer region 48. The connection 44 is placed on a carriage 82 which is in the storage position. For this purpose, the fittings 120 are positioned on the screw rims 104. The rods 116 are introduced into the slots 124 of the linings 122 and the fittings 120 are screwed to the rims 104.

The collars 118A, 118B are released to allow the outer portion 64 to rotate about the axis X-X' so the axis of the outer portion Y-Y' can reach a predetermined incline relative to the horizontal plane. The clamping collars 118 are subsequently reclamped, while keeping the locking rods 116 in a substantially horizontal position.

The connection 44 is thus fixed in rotation about the axis X-X' relative to the carriage 82. It is further fixed longitudinally relative to the carriage 82, but still remains free to move in translation along the axis X-X'.

The connection 44 is subsequently displaced along the transverse axis X-X' towards the exterior of the ship until the inner collar 118B abuts the inner end of the fitting 120.

The entrainment means 86 are subsequently activated to entrain the carriage 82 from its storage position to the position in which the connection 44 is fixed to the manifold 42. During this displacement, the carriage 82 slides along the rails 88A, 88B while being guided by said rails 88A, 88B. Since the connection 44 is fixed longitudinally relative to the carriage 82, it is displaced together with said carriage 82 until the position in which it is fixed to the manifold 42 is reached.

In this position, the inner end 66 of the inner portion 60 is positioned facing the transfer end 54 of the manifold 42, at a distance from said end.

The brake 87 of the carriage 82 is then activated to lock the carriage 82 in the fixed position thereof. The connection 44 is then displaced along the axis X-X' by sliding the rods 116 in the slots 124 until the flange 67 of the inner end 66 comes into contact with the flange 58 at the transfer end 54. The flanges 58, 67 are then fixed together by means of screws.

Since the connection 44 is transported over the platform 40 by the carriage 82, the connection 44 remains permanently in contact with the platform 40 via the carriage 82 and the frame 80. This enables the connection 44 to be fixed to the manifold 42 easily even if the sea is rough. The ship 14 subsequently approaches the installation 12 to anchor itself on said installation 12.

In a variant, the ship 14 is anchored on four anchor buoys located at a distance from the installation 12. These buoys define a zone in which to anchor the ship 14, said zone being 20 m to 25 m from the installation 12 for example.

As shown in FIG. 1, the handling means 24 are then activated to convey the free end 28 of the flexible hose 22 into the vicinity of the outer end 68 of the connection 44.

This operation is facilitated by arranging the outer end 68 so as to project beyond the ship 14.

The guide rod 72 is subsequently positioned at the entrance to the sleeve 32, and the free end 28 is pulled by the winch 74 towards the collar 70 until said free end 28 comes into contact with the collar 70. The free end 28 is then fixed to the collar 70 by means of the connector 33 in order to connect the flexible hose 22 to the tubular connection 44.

LNG can then be transferred from the reservoir 18 under the sea through the flexible hose 22, a circulation channel of the connection 44 and the pipe 52 of the manifold 42 to the tank 34 in the ship 14.

Once the transfer is complete, the flexible hose 22 is separated from the connection 44 and the connection 44 is released from the manifold 42 and subsequently returned to the storage region 50 on the ship 14.

The transfer device 16 according to the invention thus considerably simplifies the operation of connecting the flexible hose 22 to the manifold 42, by using a rigid tubular connection 44 which is transported over the platform 40 by a carriage 82 which can be displaced between a storage position and an active fixed position.

In a variant, the carriages 82 have wheels which may be power-driven to enable them to be displaced, by rolling, over the platform 40 between a storage position in the vicinity of the storage region 50 and the fixed position.

The carriages 82 are thus provided with means 87 for locking said carriages in position, comprising for example suction cups and/or guy-wires, the tension of which can be adjusted by turnbuckles.

In another variant, the connection 44 is permanently mounted to a carriage 82. The carriage 82 is thus displaced from a storage position located in the storage region 50 to a transfer region 48 of the platform 40, while remaining substantially permanently in contact with the platform 40.

In a variant shown in broken lines in FIG. 4, the carriage 42 comprises blocks 150 for adjusting the height of the inner portion 60 relative to the manifold 42.

The blocks 150, of predetermined height, are placed between the rims 106 and the fittings 120 when the fittings 120 are screwed to the carriages 42.

In another variant, a diameter-adjustable pipe (not shown) is fixed between the flange 58 of the manifold 42 and the complementary flange 67 of the connection 44 if the flanges 58 and 67 have different diameters.

The adjustable pipe is in the form of a truncated cone so as to be able to adapt to the diameters of the flanges 58 and 67 respectively.

The invention claimed is:

1. Apparatus for transferring a liquid to a ship, the apparatus comprising:

a loading platform on the ship, the loading platform having a lateral side to transfer a liquid and a central portion, the loading platform defining a transverse axis residing in a horizontal plane and extending from the lateral side to the central portion, and a longitudinal axis residing in the horizontal plane and perpendicular to the transverse axis;

at least one manifold residing on the ship and having a free end that opens out onto the platform, the at least one manifold having a transverse axis extending in the same direction as the transverse axis of the loading platform;

at least one displaceable tubular connection comprised of a rigid hollow pipe having a first end configured for disengageable connection with the free end of the manifold and a second end, opposite and spaced from the first end, configured for disengageable connection to a free end of a flexible hose that is supported by a liquid distribution installation outside the ship, the rigid hollow pipe having an interior defining a liquid transfer channel capable of transferring liquid from the flexible hose to the manifold when the first end of the rigid hollow pipe is connected to the free end of the manifold and the second end of the rigid hollow pipe is connected to the flexible hose, at least one carriage for transporting the at least one tubular connection over the platform, the carriage being displaceable over the platform in a first direction along the direction of the longitudinal axis and perpendicular to the transverse axis of the manifold to transport the tubular connection laterally and horizontally between a storage position, and an active fixed position at which the tubular connection is fixed to the manifold, wherein the first end of the rigid hollow pipe resides at the platform and the second end of the pipe resides outside a lateral side of the ship.

2. The apparatus according to claim 1, further comprising a lock for locking the carriage in a position relative to the platform in the active position, the lock being operable to be activated in the absence of the tubular connection on the carriage.

3. The apparatus according to claim 1, further comprising an entrainment device operable for entraining the carriage relative to the platform, the entrainment device being supported by the ship.

4. The apparatus according to claim 1, further a guide track on the platform for guiding the carriage wherein displacement of the carriage over the platform between the storage position and the active position is controlled along the guide track.

5. The apparatus according to claim 1, wherein the carriage comprises wheels which roll over the platform.

6. The apparatus according to claim 1, wherein in the vicinity of the active fixed position, the carriage can be displaced relative to the platform in the first direction and when the connection is mounted on the carriage, the connection is fixed relative to the carriage along the axis of the manifold and can be displaced relative to the carriage towards the manifold in a second direction along the axis of the manifold.

7. The apparatus according to claim 1, wherein the carriage comprises a cradle which rotatably receives a connection, and an adjustable blocking device operable for blocking the rotation of the connection relative to the cradle.

8. The apparatus according to claim 7, wherein the adjustable blocking device comprises at least one blocking rib which is integral with one of the tubular connection or the cradle, and a groove in the other one of the tubular connector or the cradle for receiving the blocking rib.

9. The apparatus according to claim 1, wherein the tubular connection is displaceable relative to the carriage between a storage configuration in a storage region in the ship, and in the storage configuration, the carriage is displaceable independently of the connection, and a transport configuration in which the tubular connection and the carriage are displaceable together.

10. The apparatus according to claim 1, wherein in the active position of the carriage, the tubular connection projects beyond the platform, and the manifold is located in a set-back position on the platform.

11. The apparatus according to claim 1, further comprising a plurality of the connections which are capable of being mounted on the same carriage.

12. The apparatus according to claim 1, wherein the carriage comprises a height adjustment device operable for adjusting the height of the connection relative to the height of the manifold.

13. A ship for transporting a liquid, comprising a transfer device according to claim 1, a tank in the ship for a liquid which is connected to the manifold, and the platform is integral with the ship.

14. An assembly for transferring a liquid, comprising:

an installation for transferring a liquid, the installation is located in contact with a body of water and comprises a flexible hose for distributing liquid;

a ship according to claim 13 which floats on the body of water, the flexible hose being connected to the tubular connection.

15. A method for transferring a liquid onto a ship in an assembly according to claim 14, comprising the following steps:

positioning a carriage on a platform which is on the ship, the carriage supporting a tubular connection on the carriage, wherein the tubular connector is stored on the ship when the tubular connector is at rest;

displacing the carriage over the platform between the storage position and an active position in order to transport the tubular connection over the platform while keeping the carriage in contact with the platform between said positions;

fixing the tubular connection at the active position to the manifold; and connecting the flexible hose to the tubular connection at the active position.

16. The method according to claim 15, wherein the tubular connection is displaceable relative to the carriage between a storage configuration in which the tubular connection is located in a storage region of the ship at a distance from the carriage and a transport configuration in which the tubular connection is mounted on the carriage, the step of displacing of a tubular connection from the storage configuration to the transport configuration thereof on the carriage.

* * * * *